United States Patent [19]

Atsumi et al.

[11] 4,334,511

[45] Jun. 15, 1982

[54] FUEL INJECTION SYSTEM FOR AN INTERNAL COMBUSTION ENGINE

[75] Inventors: Minoru Atsumi, Kawagoe; Toshio Nomura, Niiza; Jiro Kawahara, Tokyo, all of Japan

[73] Assignee: Honda Giken Kogyo Kabushiki Kaisha, Tokyo, Japan

[21] Appl. No.: 22,272

[22] Filed: Mar. 20, 1979

[30] Foreign Application Priority Data

Mar. 23, 1978 [JP] Japan ..... 53-33363

[51] Int. Cl.[3] ..... F02M 39/00; F02M 1/02

[52] U.S. Cl. ..... 123/454; 261/64 C

[58] Field of Search ..... 123/452–456; 261/50 A, 64 B, 64 C, 39 B; 92/85 A, 130 D

[56] References Cited

U.S. PATENT DOCUMENTS

| | | | |
|---|---|---|---|
| 2,837,072 | 6/1958 | Zupancic | 123/455 |
| 2,896,541 | 7/1959 | Barton | 92/85 A X |
| 2,957,464 | 10/1960 | Dolza | 123/453 |
| 3,956,433 | 5/1976 | Garcea | 261/64 C X |
| 3,996,906 | 12/1976 | Bobniak | 261/64 B X |
| 3,999,528 | 12/1976 | Knapp et al. | 123/454 |
| 4,128,086 | 12/1978 | Garcea | 261/64 B X |
| 4,153,018 | 5/1979 | Kimata et al. | 123/453 X |
| 4,174,692 | 11/1979 | Wessel et al. | 123/455 |

FOREIGN PATENT DOCUMENTS

| | | |
|---|---|---|
| 2553427 | 7/1976 | Fed. Rep. of Germany . |
| 2655226 | 4/1978 | Fed. Rep. of Germany . |

*Primary Examiner*—Stuart S. Levy

*Attorney, Agent, or Firm*—Armstrong, Nikaido, Marmelstein & Kubovcik

[57] ABSTRACT

A vacuum-operated air-valve actuator has a vacuum chamber held in communication with the intake air passage not only at a point between the air valve and the throttle valve but also at a point on the downstream side of the latter. In low load engine operation, the actuator is fed with a relatively high vacuum occurring on the downstream side of the throttle as well as with a lower vacuum in the Venturi and acts to increase the opening of the air valve. As the result, the vacuum in the Venturi, under which a fuel metering device operates, is reduced and accordingly the amount of fuel metered out is reduced to minimize the density of unburnt ingredients in the engine exhaust gases.

12 Claims, 5 Drawing Figures

A
D
E
M
N
R
T
Ls
Lr
Ff
Fd
Fp
Ip
Tv
1
2
3
4
5
6
7
8
9₁
9₂
10₁
10₂
11
12
13
14
15
15a
16
17
18
19
20
24
25
26
36

FUEL INJECTION SYSTEM FOR AN INTERNAL COMBUSTION ENGINE

BACKGROUND OF THE INVENTION

This invention relates to fuel injection systems for internal combustion engines and more particularly to those of the type including an intake-air flow detecting device provided on the intake-air passage or manifold duct of the engine to detect the flow of engine intake air as a value of vacuum pressure, a fuel feed pump arranged on the fuel line interconnecting a fuel injection valve fitted to the intake-air passage on the downstream side of a throttle valve and a fuel tank, and a fuel metering device interposed between the fuel injection nozzle and the fuel feed pump to meter the fuel delivered therefrom in accordance with the value of vacuum pressure transmitted from the intake-air flow detecting device.

In general, fuel injection systems of the type described are advantageous in that they are simple in construction and limited in fabrication cost but have been unsatisfactory in that, with the conventional construction, the vacuum pressure in the intake-air passage can hardly be controlled as expected in accordance with the condition of engine operation and hence the system can only contribute a little to exhaust emissions control and fuel economy.

SUMMARY OF THE INVENTION

Under these circumstances, the present invention is intended to overcome the difficulties previously encountered as described above and has for its object the provision of a new and improved fuel injection system of the type described which is simple in construction and effective to minimize exhaust emissions and fuel consumption.

According to the present invention, there is provided a fuel injection system of the type described which includes an intake-air flow detecting device comprising a vacuum detecting port opening in the intake-air passage of the engine on the upstream side of the throttle valve and communicating with a fuel metering device, an air valve arranged in the intake-air passage on the upstream side of the vacuum detecting port, and normally biased in closing direction, a vacuum-operated actuator operative to move the air valve into open position, a first vacuum passage arranged to place the vacuum chamber of the vacuum-operated actuator in communication with the intake-air passage at a point between the air valve and the throttle valve, and a second vacuum passage arranged to place the vacuum chamber of the vacuum-operated actuator in communication with the intake-air passage at a point on the downstream side of the throttle valve.

The above and other objects, features and advantages of the present invention will become apparent from the following description when taken in conjunction with the accompanying drawings.

DESCRIPTION OF THE PREFERRED EMBODIMENTS

Figures 1, 2:
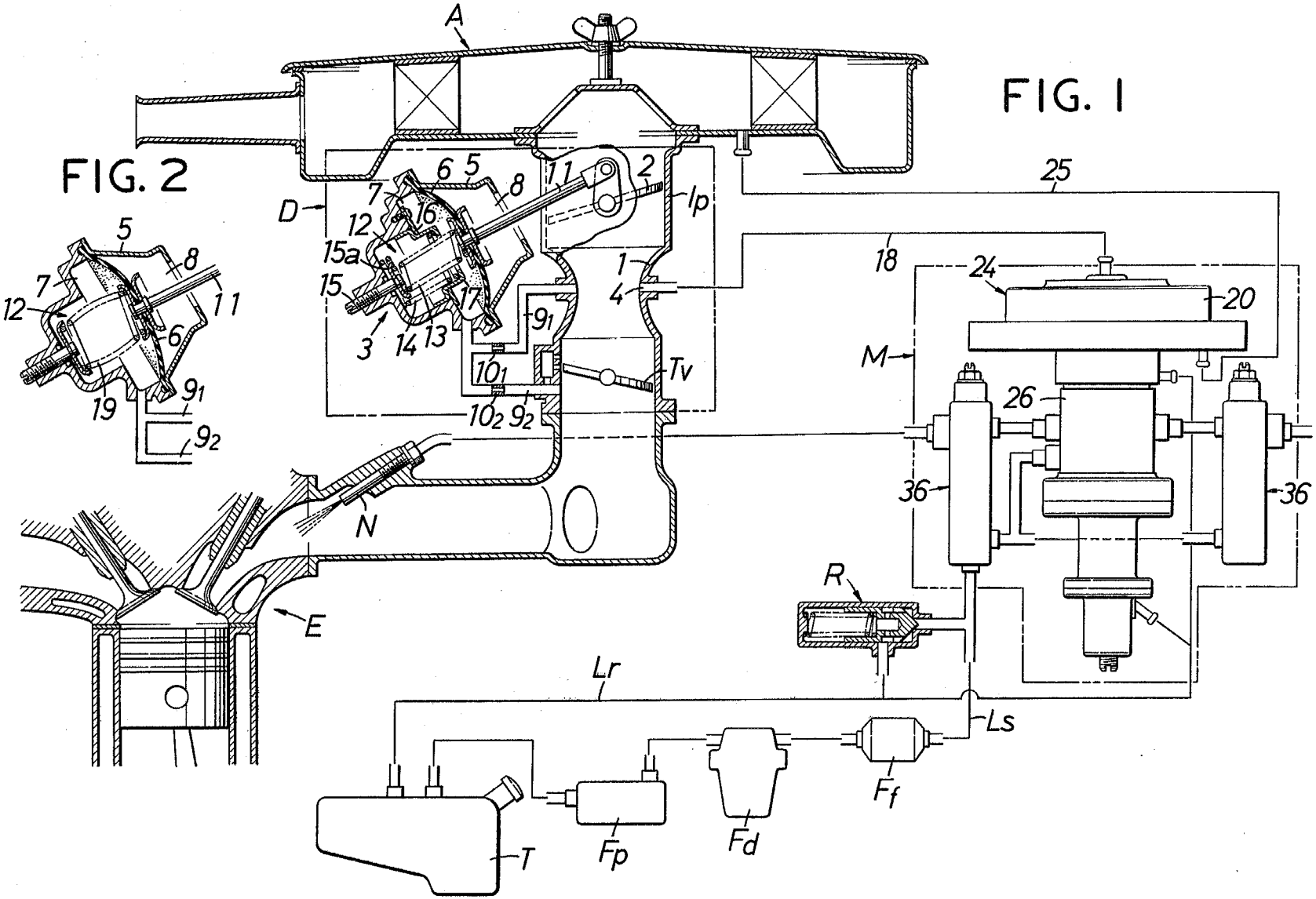
FIG. 1 is a diagrammatic general view, partly in vertical cross section, of a preferred embodiment of the present invention.
FIG. 2 is a fragmentary vertical cross-sectional view of a modification of the vacuum-operated actuator in the intake-air flow detecting device shown in FIG. 1.

Referring to the drawings and first to FIG. 1, there is illustrated a preferred form of fuel injection system of the present invention which includes a suction flow detecting device D provided on the intake-air passage Ip of an internal combustion engine E to detect the flow of engine intake air as a value of vacuum pressure, a fuel injection nozzle N fitted to the most downstream portion of the intake-air passage Ip so as to inject fuel toward the intake port of the engine E, a fuel tank T, a fuel feed pump Fp for pumping fuel out of the fuel tank, and a fuel metering device M adapted to meter the fuel delivered from the feed pump in accordance with the vacuum pressure value transmitted from the intake air flow detecting device D and to supply the fuel metered to the fuel injection nozzle N. The flow of intake air to the engine E is controlled by adjusting the opening degree of a throttle valve Tv which is pivotally supported midway of the intake-air passage Ip.

An air cleaner A is attached to the upstream end of the intake-air passage Ip and, in a fuel supply line interconnecting the fuel feed pump Fp and fuel metering device M, are interposed a fuel damper Fd, a fuel filter Ff and a pressure regulator valve R in the order named from the feed pump Fp. Fuel effluent from the pressure regulator valve R returns to the fuel tank T through a return line Lr.

In the system described, component parts are generally conventional in structure except the intake-air flow detecting device D and fuel metering device M, the construction and operation of which will next be described in detail.

First, the intake-air flow detecting device D includes a Venturi 1 formed in the intake-air passage Ip immediately above the throttle valve Tv, an air valve or damper 2 pivotally supported in the intake-air passage Ip immediately above the Venturi 1 and normally biased in closing direction, and a vacuum-operated actuator operative to open the air valve 2 against its restoring bias. A vacuum detecting port 4 is provided on the Venturi 1. The vacuum-operated actuator 3 has a fixed casing 5 the interior of which is divided into two, vacuum and atmospheric, chambers 7 and 8 by a diaphragm 6, which is operatively connected through a linkage 11 with the air valve 2. The vacuum chamber 7 is in communication with the Venturi 1 and the downstream side of throttle valve Tv, respectively, through a first and a second vacuum passage $9_1$ and $9_2$. In the first vacuum passage $9_1$ is provided a constriction $10_1$ and in the second vacuum passage $9_1$, a constriction $10_2$ which is smaller in diameter than the constriction $10_1$. Provided in the vacuum chamber 7 is a restoring spring means 12 for normally biasing the air valve 2 in closing direction.

The restoring spring means 12 includes a main coiled spring 13 and an auxiliary coiled spring 14 arranged in encircling relation thereto. As illustrated, the main coiled spring 13 is held compressed between the diaphragm 6 and an adjustable spring seat plate 15*a*, which is mounted on an adjusting screw 15 threadably fitted through the adjacent wall of the casing 5 of vacuum-operated actuator 3, so as to normally bias the diaphragm 6 in a direction to close the air valve 2. On the other hand, the auxiliary coiled spring 14 is held compressed between the end wall of vacuum chamber 7 and a movable seat plate 17 normally bearing against an annular abutment plate 16 fixed to the actuator casing 5 axially midway of the vacuum chamber 7. It will be noted that, when the air valve 2 is fully closed, as illustrated, the movable seat plate 17 is held spaced from the diaphragm 6 by a definite axial distance and the auxiliary coiled spring 14 is in inoperative state.

As will be readily seen, the load setting of main coiled spring 13 is adjustable by properly moving the adjustable spring seat plate 15*a* axially in either direction by turning the adjusting screw 15. By increasing the load setting, the opening of air valve 2 can be reduced for low, or extremely low load engine operation.

As the engine E starts to operate, vacuum pressures generate in the Venturi 1 and on the downstream side of the throttle valve Tv so that air in the vacuum chamber 7 is evacuated into the intake passage lp through the first and second vacuum passages $9_1$ and $9_2$ and, after all, there is obtained in the vacuum chamber 7 a vacuum as the resultant of the two vacuum pressures. Under such vacuum in the vacuum chamber, the diaphragm 6 is deflected leftwardly downward as viewed in FIG. 1 until the vacuum force acting thereon is balanced against the spring force of the restoring spring means 12 with the air valve 2 properly opened. In this manner, a vacuum pressure of a value corresponding to the opening degree of air valve 2 is obtained in the Venturi 1 and led through the vacuum detecting port 4 and a vacuum line 18 to the fuel metering device M.

Incidentally, in a low opening range of the throttle valve Tv, that is, in the state of low load operation of the engine E, a high vacuum arises on the downstream side of the throttle valve Tv and the vacuum chamber 7 is fed with such vacuum through the second vacuum passage $9_2$ as well as with the vacuum through the first vacuum passage $9_1$. Accordingly, the air valve 2 is opened to a larger extent than in cases where it be actuated solely under the vacuum fed through the first vacuum passage $9_1$ and the value of control vacuum as detected through the vacuum detecting port 4 is reduced compared with that detected as by an intake-air flow detecting device provided with a single vacuum passage $9_1$. As the result, a smaller amount of fuel is metered by the fuel metering device M and injected through the fuel injection nozzle N and thus the engine E is fed with a relatively lean mixture, for example, of an air-fuel ratio of the order of 16, to operate with a maximum of fuel economy.

On the other hand, in a high opening range of throttle valve Tv, that is, in the state of high load operation of the engine E, the vacuum on the downstream side of throttle valve Tv is reduced to approach the vacuum in the Venturi 1 so that the combined vacuum in the vacuum chamber 7 is substantially the same as that obtained with the first vacuum passage $9_1$ provided alone and, accordingly, the opening degree of air valve 2 is substantially the same as that obtainable if the air valve is actuated solely under the vacuum fed through the first vacuum passage $9_1$. The value of control vacuum as detected through the vacuum detecting port 4, therefore, is substantially the same as that detected by an intake air flow detecting device provided only with a first vacuum passage $9_1$ and, accordingly, fuel to be injected through the fuel injection nozzle N is metered by the fuel metering device in an amount proportional to the intake air flow.

Further, with the system of the present invention, as the engine enters in a high load range of operation, above all, the vacuum in the Venturi 1 is raised with increase in intake air flow and as the vacuum in vacuum chamber 7 increases, the diaphragm 6, acting to compress the main coiled spring 13, comes first into pressure contact with the movable spring seat plate 17 at a definite point midway of the stroke of the diaphragm to start pushing back the seat plate 17. From now on, therefore, the diaphragm 6 must work not only against the resilience of the main coiled spring 13 but also against that of the auxiliary coiled spring 14 and the force of the diaphragm 6 effective to actuate the air valve 2 in opening direction is detracted as much as the resistance of auxiliary coiled spring 14. As the result, the value of control vacuum as detected through the vacuum detecting port 4 in Venturi 1 is corrected to increase and a more or less increased amount of fuel is metered at the fuel metering device M to make the fuel-air mixture richer, thereby enabling the engine E to remain in a satisfactory state of operation under high load.

Incidentally, the restoring spring means 12 may be modified according to the characteristics required thereof in cases where the control vacuum is to be corrected to increase in high output operation of the engine, as described above. For example, the spring means 12 may take the form of a multiple coil spring the spring rate of which increases stepwise as it is compressed with movement of the diaphragm 6 in a direction to open the air valve 2, or the form of a barrel-shaped coiled spring such as shown in FIG. 2 at 19, which has a spring rate continuously increasing in direct proportion to the square of the amount of contraction proceeding under the action of diaphragm 6.

Description will next be made of the construction and operation of the fuel metering device M with reference to FIG. 3.

The metering device M includes a vacuum-responsive actuator 24 having a casing 20 the interior of which is divided by means of a diaphragm 21 into two chambers, i.e., an upper, vacuum chamber 22 and a lower, atmospheric chamber 23. The control vacuum taken from the Venturi 1 is led into the vacuum chamber 22 by way of the vacuum line 18 while the atmospheric chamber 23 is in communication with the atmosphere through an air line 25 and the air cleaner A.

Provided beneath the vacuum-responsive actuator 24 is a spool valve the cylindrical-shaped casing 26 of which is fixedly arranged on the underside of the casing 20 of the actuator 24 coaxially therewith. In the top portion of the valve casing 26 is fitted a sleeve 27 in which a spool valve element 28 having an upper, metering land 28*a* and a lower, guiding land 28*b* formed thereon is slidably fitted. The spool valve element 28 has an upper stem portion 28*c* connected at the top with the diaphragm 21 of vacuum-responsive actuator 24 and a lower stem portion 28*d* secured at the bottom to the top end of a restoring spring 29, which normally urges the valve element 28 in a vertically downward, restoring direction.

In the embodiment illustrated, the restoring spring 29 takes the form of a coiled tension spring and is arranged on the axis of spool valve 28 between the lower valve stem 28*d* and the bottom of valve casing 26 to enable the spool valve at all times to operate smoothly with a self-centering function. Specifically, the restoring spring 29 is anchored at the bottom to the valve casing 26 through the intermediary of an adjusting bolt 30 threadably fitted in the bottom end wall of valve casing 26 so that the load setting of the restoring spring 29 may be adjusted by turning the adjusting bolt 30.

The upper and lower land portions 28*a* and 28*b* of the spool valve element 28 are shouldered on one side thereof to form reduced-diameter portions 28*a'* and 28*b'*, respectively, in order to reduce the area of sliding contact between the inner wall surface of sleeve 27 and the land portions 28*a* and 28*b* thereby to minimize the hysteresis of frictional resistance occurring upon sliding movement of the spool valve element 28 in sleeve 27.

Figure 4:
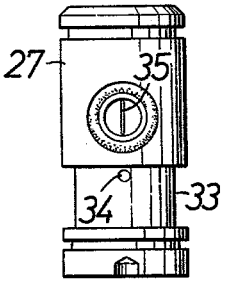
FIG. 4 is a side elevational view of the sleeve in the fuel metering device of FIG. 3.

Further, the valve casing 26 is formed with a fuel inlet port 31 which communicates with the fuel feed pump Fp and a fuel exit port 32 which communicates with the fuel injection nozzle N. On the other hand, the sleeve 27 is formed around the outer periphery thereof with an annular groove 33 which communicates with the inlet port 31, a radial hole 34 which provides communication between the annular groove 33 and the inside space or axial bore of the sleeve 27, and an axially extending metering slit 35 (see also FIG. 4) which provides communication between the exit port 32 and the inside space of sleeve 27. It is to be noted that the radial hole 34 is always in communication with the annular space between the two land portions 28*a* and 28*b* of the spool valve element and the metering slit 35 is arranged so that its opening is controlled by the lower edge of upper metering land 28*a*.

In operation, the control vacuum as taken through the vacuum port 4 is directed through control vacuum line 18 into the vacuum chamber 22 of vacuum-responsive actuator 24 and, when it exceeds a definite value, acts to lift the spool valve element 28 through the intermediary of the diaphragm 21 so that the opening area of metering slit 35 is increased until the lifting force of diaphragm 21 is counterbalanced by the tension of restoring spring 29 and the spool valve element 28 gets stabilized. The opening degree of metering slit 35 is thus in direct proportion to the value of the control vacuum introduced into the vacuum chamber 22. Incidentally, the position of the spool valve element 28 stabilized is adjustable by varying the load setting of restoring spring 29 by turning the adjusting bolt 30.

On the other hand, fuel delivered from the feed pump Fp is directed through the inlet port 31, annular groove 33 and radial hole 34 to flow into the annular space between the two land portions 28*a* and 28*b* of spool valve element 28 and thence flow out through the metering slit 35 and exit port 32 to be finally injected through the fuel injection nozzle N. It is to be noted that the amount of fuel injected in this manner is proportional to the opening degree of metering slit 35 and hence to the value of control vacuum.

Such proportionality, however, holds only under the condition that the pressure difference between the inlet and exit ports 31 and 32 remains unchanged and, to satisfy this condition, a differential pressure regulator 36 is provided between the inlet and exit ports 31 and 32.

The differential pressure regulator 36 is composed of a cylinder 37, a balancing piston 40 slidably fitted in the cylinder to define therein a first pressure chamber 38 and a second pressure chamber 39, and a coiled spring 41 normally urging the piston 40 in a direction toward an annular abutment 42 formed on the wall of the first pressure chamber 38. The coiled spring 41 is held in compression between the piston 40 and a spring seat 50*a* formed on an adjusting bolt 50, which is treadably fitted to the top of cylinder 37. The first and second pressure chambers 38 and 39 are in communication with the inlet and exit ports 31 and 32 of spool valve casing, respectively. In the peripheral wall of second pressure chamber 39 is formed a control aperture 43 the opening area of which is controlled by the balancing piston 40 and through which aperture fuel metered is fed to the fuel injection nozzle N. The maximum opening area of control aperture 43 is to be set larger than that of the metering slit 35 of the spool valve 28.

In operation, whenever the pressure in the first pressure chamber 38 rises above a specified level, the balancing piston 40 under the differential pressure between the first and second pressure chambers 38 and 39 rises to narrow the control aperture 43. Similarly, whenever the pressure in the first pressure chamber 38 is reduced below the specified level, the balancing piston 40 descends under the differential pressure between the two pressure chambers 38 and 39 so that the area of the control aperture 43 is increased. In either event, the balancing piston 40 becomes stable as the differential pressure between the two pressure chambers 38 and 39 restores its specified value. In this manner, the differential pressure is kept at all times substantially at a definite level irrespective of any pressure fluctuations of fuel feed pump Fp and changes in flow resistance of the fuel system. This means that the pressure difference between the inlet and exit ports 31 and 32 remains constant. The level of such pressure difference can be readily adjusted by varying the load setting of coiled spring 41 by turning the adjusting bolt 50 at the regulator head.

Figure 3:
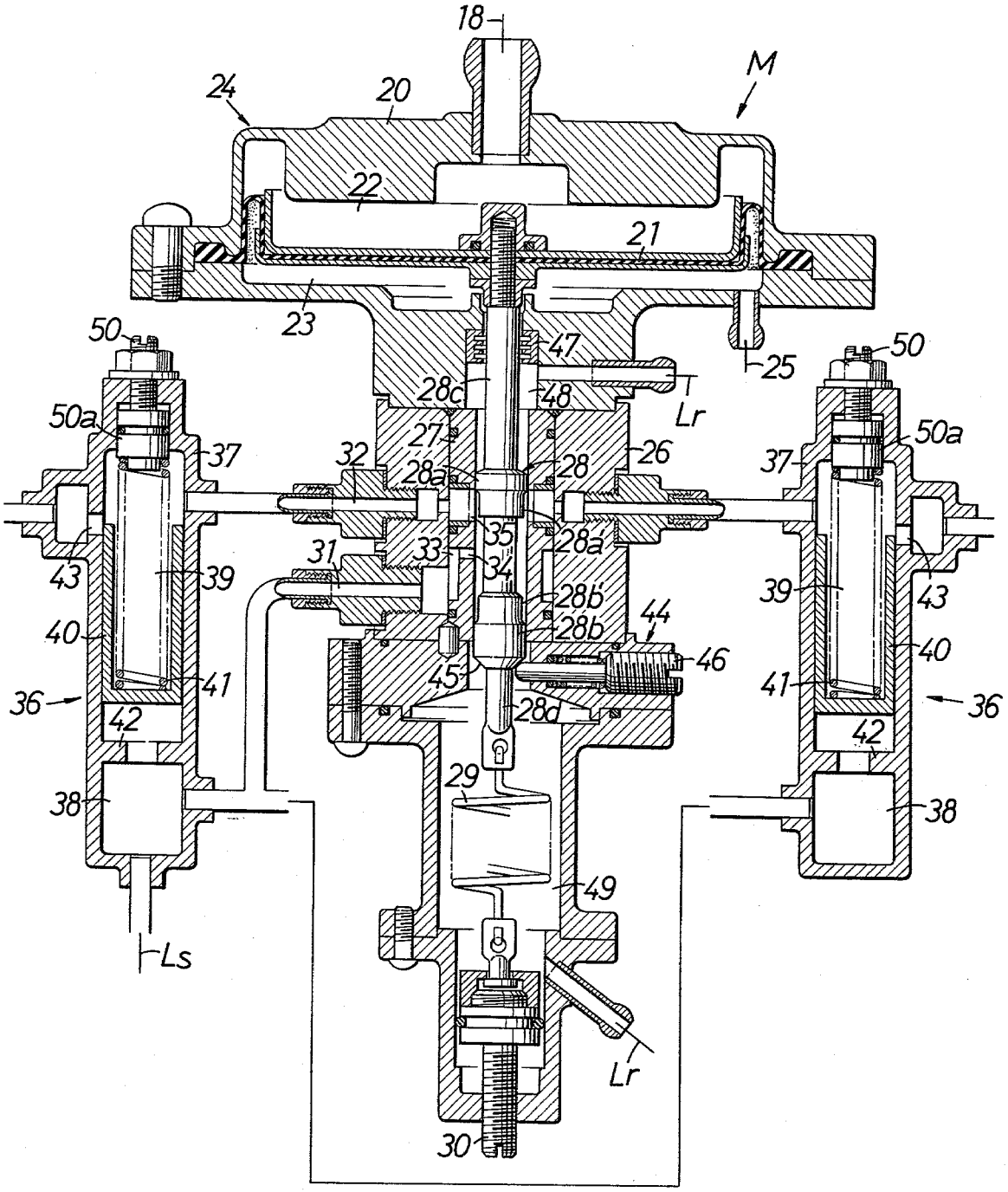
FIG. 3 is an enlarged vertical cross section of the fuel metering device shown in FIG. 1.

In FIG. 3, reference numeral 44 indicates idling adjusting means provided on the fuel metering device M so that during engine idling the rate of fuel injection through nozzle N may be adjusted independently.

As illustrated, the idling adjusting means 44 comprises a portion of the spool valve element 28, for example, a tapered bottom end portion 45 of the guiding land 28*b* thereof and an adjusting screw 46 threadably fitted to the adjacent wall of valve casing 26 and engageable at the inner end with the tapered land end portion 45.

During engine idling, since the control vacuum fed in the vacuum chamber 22 is low, the spool valve element 28 is held under the bias of restoring spring 29 in its idling position with the tapered bottom portion 45 engaging with the adjusting screw 46 and the opening degree of metering slit 35 in this valve position determines the rate of fuel injection for idling. The idling position of spool valve element 28 and hence the rate of fuel injection for idling are adjustable by turning the adjusting screw 46 to displace its inner end toward or away from the valve axis thereby to vary the radial distance of the point of engagement of the tapered portion 45 of spool valve element 28 with the inner end of adjusting screw 46.

As long as the sleeve 27 and spool valve element 28 are held in sliding relation to each other, it is unavoidable that a more or less portion of the fuel entering the annular space between the upper and lower lands 28*a* and 28*b* leaks through the sliding regions between the two components to flow out of the sleeve 27. To meet this situation, the fuel metering device M is provided with means for circulating the leak fuel to the fuel tank T, as described below.

In FIG. 3, reference numeral 47 indicates a labyrinth seal fitted in the bottom of the casing 20 of vacuum-responsive actuator 24 in encircling relation to the upper valve stem 28*c* of spool valve 28, and 48 indicates a hollow space defined between the labyrinth seal 47 and the upper, metering land 28*a* and communicating with the fuel return line Lr previously referred to. Another hollow space 49, formed immediately below the lower, guiding land 28*b*, is also in communication with the fuel return line Lr.

With this arrangement, fuel leak between the sliding surfaces of the sleeve 27 and spool valve element 28 enters the hollow spaces 48 and 49 and thence is circulated to the fuel tank T through the return line Lr. Labyrinth seal 47 serves the purpose of precluding any ingress into the atmospheric chamber 23 of vacuum-responsive actuator 24 of the leak fuel as entering the upper hollow space 48. The labyrinth seal 47 may be replaced, if desired, by a bellows seal that is arranged between the upper valve stem 28*c* and the actuator casing 20. Either type of seal presents no substantial resistance to operation of the spool valve 28 and is advantageously usable for smooth valve operation.

Figure 5:
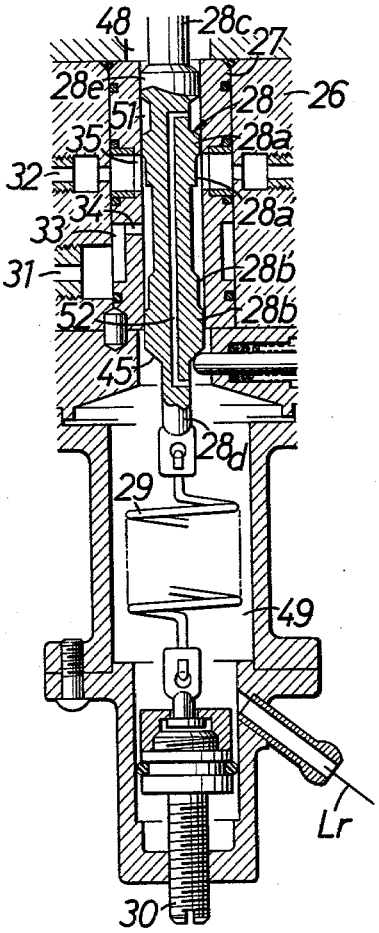
FIG. 5 is a view similar to FIG. 3, illustrating a modification of the fuel metering device shown in FIG. 1.

In FIG. 5 is illustrated alternative means for circulating fuel leak between the sliding surfaces of sleeve 27 and spool valve element 28 to the fuel tank T. Specifically, the spool valve element 28 in this instance is further formed thereon with a sealing land 28*e* above the metering land 28*a* and a passage 52 is formed through the spool valve element 28 which interconnects the annular space 51 between the sealing and metering lands 28*e* and 28*a* and the hollow space 49 immediately below the guiding land 28*b*. In this embodiment, leak fuel is all collected in the hollow space 49 to return through the return line Lr to the fuel tank T and any need for return line connection to the upper hollow space 48 is eliminated. Further, in this embodiment, any ingress of leak fuel into the atmospheric chamber 23 of vacuum-responsive actuator 24 is completely precluded without use of any sealing member therefor and this enables the fuel metering device to be made particularly simple in construction.

As described herein, in the fuel injection system of the present invention, the vacuum-operated actuator for opening the air valve provided in the intake-air passage on the upstream side of the vacuum detecting port is adapted to operate under the combined vacuum or the sum of the vacuum pressure at a point intermediate the air valve and the throttle valve and the vacuum pressure downstream of the latter so that the exact control vacuum as expected, corresponding to the engine operation condition, can be detected through the vacuum detecting port and, particularly in low load operation of the engine, the value of such control vacuum be properly corrected in a decreasing direction. Accordingly, under such control vacuum, the fuel metering device can be controlled accurately in accordance with the engine operation condition to keep the air-fuel mixture ratio at all times stabilized at an appropriate level. Particularly, in low load conditions of the engine, most frequent in its normal use, the air-fuel ratio can be stabilized at a level to form a relatively lean mixture thereby to minimize the density of unburnt ingredients in the engine exhaust gases and the fuel consumption as well. The system of the invention is further advantageous in that it is particularly simple in construction and trouble-free.

While several embodiments of the present invention have been shown and described, it will be apparent to those skilled in the art that various changes and modifications may be made therein without departing from the spirit of the invention or the scope of the appended claims.

What is claimed is:

1. An improved fuel injection system for an internal combustion engine comprising an intake passage, an air valve, said air valve being in the intake passage normally biased to a closed position, a throttle valve disposed in the intake passage downstream of the air valve, an intake-air flow detecting device for detecting a flow rate of engine intake air as a value of vacuum pressure, a fuel injection nozzle opening to the intake passage at a location downstream of the throttle valve adjacent the engine, a fuel feed pump in a fuel line interconnecting a fuel tank and the fuel injection nozzle, a fuel metering device in the fuel line for metering the fuel delivered from the fuel pump in response to vacuum pressure transmitted from the intake-air flow detecting device to supply a metered amount of fuel to the fuel injection nozzle, the intake-air flow detecting device having a vacuum-operated actuator operable to move the air valve into an open position and restoring spring means arranged to normally bias the air valve in a closing direction, the improvement wherein: a vacuum detecting port communicating with the fuel metering device is open to the intake passage at a location between the air valve and the throttle valve, for controlling the operation of the fuel metering device in response to vacuum pressure in the intake passage; and the vacuum-operated actuator has a vacuum chamber which is in communication with the intake passage, both at a location between the air valve and the throttle valve through a first vacuum passage and at a location on the downstream side of the throttle valve through a second vacuum passage whereby, in low load operation of the engine in which the opening degree of the throttle valve is small, high vacuum pressure in the intake passage downstream of the throttle valve is introduced into the vacuum chamber of the vacuum-operated actuator by way of the second vacuum passage to increase the opening degree of the air valve to control vacuum pressure in the intake passage between the air valve and the throttle valve in a decreasing sense.

2. A fuel injection system as claimed in claim 1, in which said restoring spring means comprises a spring member such as a coiled spring accommodated in the vacuum chamber of said vacuum-operated actuator so as to bias the operating member thereof in restoring direction and an adjuster operable to adjust the fixed end of said spring member toward and away from said operating member.

3. A fuel injection system as claimed in claim 1, in which said restoring spring means comprises a plurality of spring members having in combination a spring rate increasing stepwise with opening movement of said air valve.

4. A fuel injection system as claimed in claim 1, in which said restoring spring means comprises a main coiled spring arranged in compression in the vacuum chamber of said vacuum-operated actuator and an auxiliary coiled spring arranged in compression in the vacuum chamber of said vacuum-operated actuator in encircling relation to said main coiled spring, said main coiled spring having the operating end thereof held at all times in engagement with the operating member of said vacuum-operated actuator, said auxiliary coiled member being operated so that the operating end thereof comes into engagement with the operating member of said vacuum-operated actuator only when the latter reaches a predetermined intermediate position in the working stroke thereof.

5. A fuel injection system as claimed in claim 1, in which said restoring spring means comprises a coiled spring designed to have a spring rate increasing continuously with opening movement of said air valve.

6. A fuel injection system as claimed in claim 1, in which said fuel metering device includes a vacuum-responsive actuator having a vacuum chamber communicating with said vacuum detecting port and a spool valve comprising a valve casing directly connected to the casing of said vacuum responsive actuator, said spool valve further comprising a spool valve element slidably fitted in said valve casing and connected with the movable member of said vacuum-responsive actuator and a restoring spring arranged normally to bias said spool valve element in restoring direction opposite to the direction of action of said vacuum-responsive actuator, said valve casing being formed therein with a fuel inlet port connected to said fuel feed pump, a fuel exit port connected to said fuel injection nozzle and a control slit inserted in the fuel passage between said fuel inlet and exit ports and the opening area of which is adjustable upon displacement of said spool valve element.

7. A fuel injection system as claimed in claim 6, in which said fuel metering device further comprises a differential pressure regulator including a cylinder, a balancing piston slidably fitted in said cylinder and defining therein a first pressure chamber communicating with said fuel inlet port and a second pressure chamber communicating with said fuel exit port, and spring means for biasing said piston in a direction toward said first pressure chamber, said cylinder being formed in the side wall thereof with a control aperture whose area is adjusted with displacement of said balancing piston.

8. A fuel injection system as claimed in claim 6, in which said fuel metering device further comprises an idling adjusting bolt threadably fitted to said valve casing and engageable at the inner end thereof with said spool valve element to define the limit of restoring movement of the latter.

9. A fuel injection system as claimed in claim 6, in which said restoring spring of said spool valve comprises a coiled tension spring arranged on the valve axis between said spool valve element and said valve casing.

10. A fuel injection system as claimed in claim 6, in which said restoring spring of said spool valve has its fixed end arranged so as to be adjustable toward and away from said spool valve element.

11. A fuel injection system as claimed in claim 6, in which said spool valve element has its landed portion presented at the outer end thereof into a hollow space defined in said valve casing and communicating with the fuel tank.

12. A fuel injection system as claimed in claim 6, in which a seal member of the labyrinth or bellows type is inserted in that wall portion of the casing of said vacuum-responsive actuator which defines a hollow space in cooperation with the casing of said spool valve in fitting relation to the adjacent stem portion of said spool valve element.

* * * * *